United States Patent [19]

Schwarz et al.

[11] Patent Number: 4,476,899

[45] Date of Patent: Oct. 16, 1984

[54] BRAKING MECHANISM FOR A SHED-FORMING MACHINE

[75] Inventors: Rudolf Schwarz, Horgen-Zuerich; Walter Kleiner, Hirzel-Zuerich, both of Switzerland

[73] Assignee: Staeubli Ltd., Horgen-Zuerich, Switzerland

[21] Appl. No.: 425,137

[22] Filed: Sep. 27, 1982

[30] Foreign Application Priority Data

Nov. 13, 1981 [CH] Switzerland ..... 7286/81

[51] Int. Cl.[3] ..... D03D 51/08

[52] U.S. Cl. ..... 139/1 E; 139/66 R; 139/336

[58] Field of Search ..... 139/1 E, 1 R, 66 R, 139/336, 55.1

[56] References Cited

FOREIGN PATENT DOCUMENTS 675282 5/1939 Fed. Rep. of Germany ..... 139/336
2155636 3/1973 Fed. Rep. of Germany ..... 139/1 E
447700 5/1936 United Kingdom ..... 139/66 R
502538 3/1939 United Kingdom ..... 139/336
2041012 9/1980 United Kingdom ..... 139/336

*Primary Examiner*—James Kee Chi
*Attorney, Agent, or Firm*—Flynn, Thiel, Boutell & Tanis

[57] ABSTRACT

A weaving machine is operationally connected to a shed-forming machine which includes a drive shaft and a braking mechanism. The latter includes a braking disk which is axially slidably supported on the drive shaft of the shed-forming machine. The braking disk can, during movement thereof, come into frictional engagement with a stationary counterpart. In an alternative embodiment, a modified pick-finding device is used as a brake. In the case of a halt of the weaving machine which is to be carried out quickly, for example during a thread break, the braking mechanism of the shed-forming machine is actuated to relieve the braking mechanism of the weaving machine, and thus no great braking action need be transmitted through the drive for the shed-forming machine.

16 Claims, 4 Drawing Figures

BRAKING MECHANISM FOR A SHED-FORMING MACHINE

FIELD OF THE INVENTION

This invention relates to a weaving machine operatively connected to a shed-forming machine and, more particularly, to such an arrangement in which the shed-forming machine has a drive shaft and a braking mechanism.

BACKGROUND OF THE INVENTION

During thread breaks or other irregularities in a weaving machine, it is automatically stopped, and the braking operation must take less than one rotation of the machine's drive crankshaft. The constantly increasing working speeds of weaving machines and the increase in their widths has required increasingly stronger braking mechanisms. If the heddle frames of the weaving machines are controlled by shed-forming machines, a considerable part of the braking force is needed for braking the shed-forming machine and the heddle frames, which at that time are in a phase of their movement.

It has now been suggested to stop the shed-forming machine simultaneously with the weaving machine through a separate braking mechanism, which causes the braking forces which must be produced by each braking mechanism to be reduced and simultaneously effects a relief of the forces exerted on drive members between the weaving and shed-forming machines. Since the braking of the weaving and shed-forming machines occurs simultaneously, it is controlled by the control system of the weaving machine.

A goal of the invention is to provide a strong braking mechanism of the above-mentioned type for a weaving machine, in which many of the conventional structural elements of a shed-forming machine can be used and thus no significant structural changes are necessary.

SUMMARY OF THE INVENTION

This is achieved with a braking mechanism which includes a friction coupling having a braking member or disk which is axially movably supported on the drive shaft of the shed-forming machine, axial movement thereof being controlled by the control system of the weaving machine simultaneously with operation of its own brake. In a preferred embodiment, the braking disk is fixed against rotation with respect to the shaft and, in the range of axial movement of the braking disk, a stationary or at least rotationally braked counterpart is provided. The braking disk is operatively coupled to a control part which effects axial movement thereof to actuate and release the braking effect.

The actual friction brake can be designed as desired. The moving or the rotational energy is either destroyed by friction with a fixed member or is used to drive a second member which is ready for rotation but which is either stopped over a longer available time period or has a certain inertia which overcomes the rotational energy.

In a shed-forming machine having a pick finding device, and in particular having a special drive motor for pick finding, a part of the pick-finding device can be utilized for the braking action.

BRIEF DESCRIPTION OF THE DRAWINGS

Three exemplary embodiments of the invention are illustrated in the drawings, in which.

DETAILED DESCRIPTION

Figure 1:
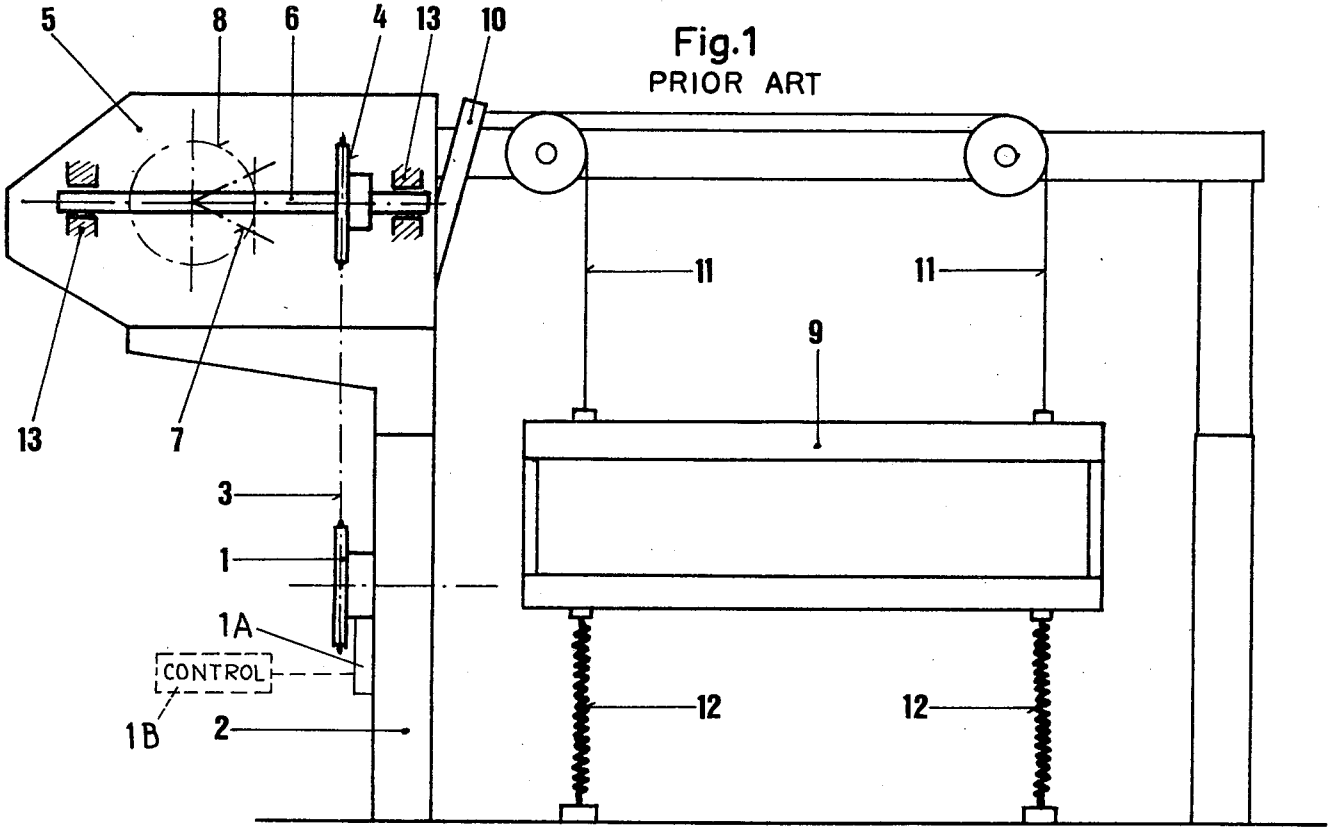
Fig.1 PRIOR ART
FIG. 1 is a schematic side view of a conventional weaving machine with an attached, conventional shed-forming machine.

FIG. 1 schematically illustrates a conventional weaving machine 2, to which is connected a shed-forming machine 5. The shed-forming machine 5 is driven by a sprocket wheel 1 provided on the crankshaft of the drive mechanism of weaving machine 2, a chain 3 and a sprocket wheel or drive member 4 which is supported rotatably on the drive shaft 6 of the shed-forming machine. The sprocket wheel 4 drives the shaft 6 through a not illustrated coupling, and thus drives the two engaged bevel gears 7 and 8 of the shed-forming machine. The drive shaft 6 is supported rotatably in side walls or shields 13 of the shed-forming machine 5.

A shed-forming machine of this general type is disclosed, for example, in U.S Pat. No. 4,428,404 and entitled PICK-FINDING MECHANISM WITH CREEPING SPEED.

The weaving machine 2 includes a conventional braking mechanism 1A which is controlled by a conventional control arrangement 1B.

A rocking lever 10 operatively driven in a conventional and not illustrated manner by the shed-forming machine 5 can, through the heddle-frame actuating devices 11, pull the heddle frame 9 upwardly against the force of two return springs 12.

The shaft on which the bevel gear 8 is mounted preferably drives a not illustrated lifting unit, for example a lifting unit of the type commonly known as a rotation dobby, and the lifting unit then controls movement of the lever 10. This is not a part of the present invention and therefore not described in detail.

Figure 2:
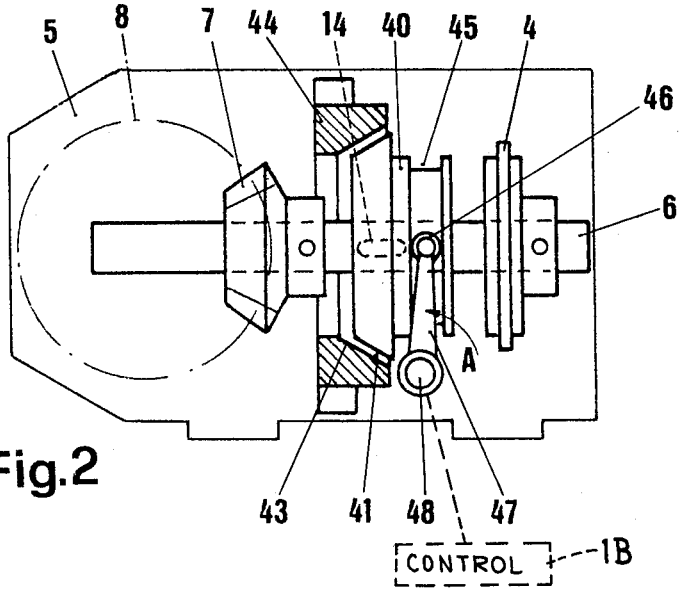
FIG. 2 is a fragmentary side view of a shed-forming machine embodying the invention and having a drive shaft and a braking mechanism with a fixed braking member.

In the inventive embodiment of a shed-forming machine according to FIG. 2, the sprocket wheel 4 and the bevel gear 7 are fixedly secured on the drive shaft 6 of the shed-forming machine 5. The tooth ring of the bevel gear 8, which is positioned at a right angle with respect to and cooperates with the bevel gear 7, is illustrated schematically.

Between the sprocket wheel 4 and the bevel gear 7 is positioned a braking member or disk 40, which is axially movably supported on and fixed against rotation with respect to the drive shaft 6 by means of a wedge or key 14. The braking surface 41 of the braking disk 40 is of frusto-conical shape. Opposite the braking surface 41, a frusto-conical counter-surface 43 is provided on a brake-counter-piece or member 44 which is connected fixedly to the housing of the shed-forming machine 5. For effecting control of the braking disk 40, it has an annular groove 45 which receives a roller 46 rotatably supported on a control lever 47 which is pivotally supported by an axle 48.

When the shed-forming machine receives an indication from the weaving machine to stop the shed-forming machine and its dobby, the control lever 47 is pivoted counterclockwise according to the arrow A and moves the disk 40 leftwardly. The two braking surfaces 41 and 43 thus move into frictional engagement with one another. The drive shaft 6 and therewith the shed-forming machine is stopped. By pivoting the lever in a direction opposite the arrow A, the braking action is released.

Pivotal movement of the lever 47 is effected by the control arrangement 1B (FIGS. 1 and 2) of the weaving machine 2.

Figure 3:
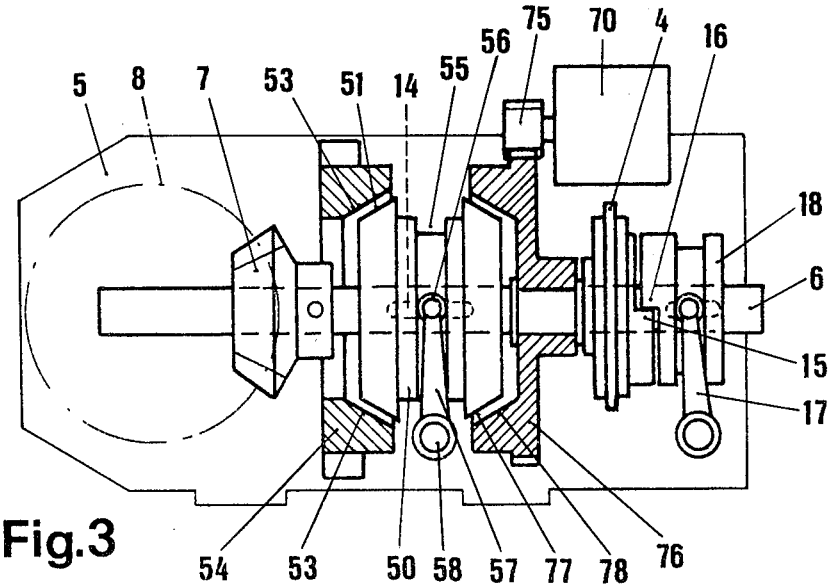
FIG. 3 is a fragmentary side view similar to FIG. 2 of a second shed-forming machine which embodies the invention and has a pick finder.

In the modified embodiment according to FIG. 3, one again recognizes a shed-forming machine 5 with a drive shaft 6, on which is fixed a bevel gear 7 which cooperates with a bevel gear 8. A sprocket wheel 4 is rotatably supported on and fixed against axial movement with respect to the shaft 6, and has thereon one tooth 15 of a single-tooth coupling. The other tooth 16 of this coupling is provided on a sleeve or coupling member 18 which can be moved axially on the shaft 6 by a pivotally supported lever 17. The shed-forming machine can be uncoupled from the weaving machine drive with this coupling for the purpose of facilitating pick finding.

A roller rotatably supported on the free end of the lever 17 is received in an annular groove provided in the sleeve 18.

The braking disk 50 is axially movably supported on the drive shaft 6 and is fixed by a key or wedge 14 against rotation with respect to the drive shaft 6. Also, the braking disk 50 has a frusto-conical braking surface 51 which can cooperate with a frusto-conical counter-surface 53 which is fixedly supported on the shed-forming machine housing. For controlling the braking disk 50, an annular groove 55 is provided therein and receives a roller 56 provided on a control lever 57 which is pivotally supported by an axle 58.

As already mentioned, a pick-finding device is built into this shed-forming machine, which pick-finding device includes a drive motor 70 having a driving pinion 75 on its shaft which engages a member or gear 76 which is rotatably but not axially movably supported on the drive shaft 6 of the shed-forming machine. The coupling for the pick-finding device includes the braking disk 50. More specifically, movement of the braking disk 50 toward the sprocket wheel 4 creates frictional contact between a frusto-conical friction surface 77 on the braking disk 50 and a frusto-conical friction surface 78 on the gear 76. With this, the drive force of the motor 70 can be transmitted to the drive shaft 6, and one obtains the normal function of a pick-finding device. This mode of operation is initiated through a simultaneous clockwise movement of the control levers 17 and 57. Braking disk 50 and control lever 57 thus have a double function, namely, on one hand, stopping of the shed-forming machine and, on the other hand, pick finding.

The frictional engagement between the surfaces 77 and 78, which serves the pick-finding operation, can alternatively be constructed as a toothed engagement.

Figure 4:
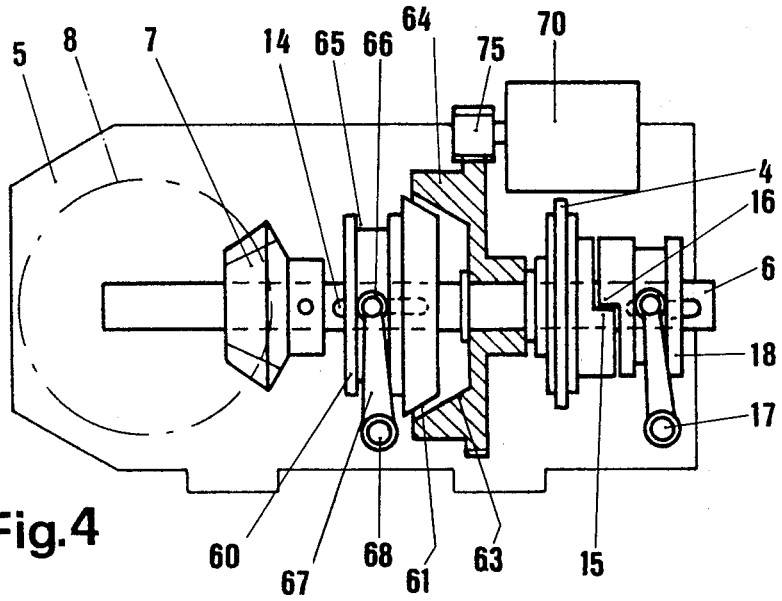
FIG. 4 is a fragmentary side view similar to FIG. 2 of a further shed-forming machine embodying the invention, in which a pick finder serves directly as a braking mechanism.

FIG. 4 illustrates a further embodiment of a shed-forming machine having a pick finder. A bevel gear 7 which cooperates with a counter-gear 8 is fixedly mounted on the drive shaft 6 of this shed-forming machine. The sprocket wheel 4, which has a tooth 15 of a single-tooth coupling thereon, is supported rotatably on the shaft 6 but is fixed against axial movement. The other tooth 16 of this coupling is provided on a sleeve 18 which can be moved axially by a control lever 17. The shed-forming machine can be uncoupled from the weaving machine drive with this coupling for the purpose of facilitating pick finding.

The drive motor 70 of the pick finder drives, with its driving pinion 75, a gear 64 which is freely rotatably but axially nonmovably supported on the drive shaft 6 of the shed-forming machine. Opposite a frusto-conical friction surface 61 thereon is a frusto-conical friction surface 63 on a braking disk or coupling sleeve 60 which is axially movably supported on the drive shaft 6 and is fixed against rotation with respect thereto by a key. The two friction surfaces 61 and 63 can be moved into engagement with one another by a control lever 67 for facilitating pick finding, after which the switched-on drive motor 70 rotates the shed-forming machine forwardly or rearwardly, so that a possibly defective pick can be found and exposed. Simultaneously with the lever 67, the control lever 17 is swung clockwise, which causes the shed-forming machine to become uncoupled from the weaving machine.

The entire pick-finding device can also be used as a braking mechanism for the shed-forming machine, the two teeth 15 and 16 being engaged. In comparison to the inventive braking mechanism according to FIGS. 2 and 3, the braking mechanism according to FIG. 4 includes the braking disk 60 which is axially movable on the drive shaft 6, the annular frusto-conical braking surface 61 and the frusto-conical counter-surface 63 on the gear 64. The braking disk 60 is moved by the control lever 67, which is pivotally supported by the axle 68, and a roller 66 which is rotatably supported on the lever 67 and received in an annular groove 65 in the disk 60.

For starting the braking operation, the braking disk 60 is moved to the right by swinging the control lever 67 clockwise, which causes the two friction surfaces 61 and 63 to move into frictional contact and to transmit the rotational forces of the drive shaft 6 onto the gear 64. During this braking operation, the energy of the shaft 6 is transmitted through the gear 64 and pinion 75 to the drive motor 10, which is under current only a limited amount. In order to brake particularly effectively, the motor can be a braking or stop motor, or a magnetic field can be set up during the braking operation in a conventional motor, which magnetic field resists rotation of the motor shaft. It is also possible to build a freewheeling arrangement into the transmission to permit the motor which has been accelerated to decelerate freely during the braking operation.

A different modification includes a self-locking gearing, for example in the form of a worm gear, being installed between the motor 70 and the gear 64. The braking of the shed-forming machine is created when the engaged friction surface 61 rubs on the blocked, inert gear 64 which is securely held against movement by such gearing.

In this use of the pick-finding device as a braking mechanism only a friction coupling and not a toothed coupling can be used between the surfaces 77 and 78.

If the gearing of the pick finder according to FIG. 4 lacks the self-locking character, the gearing and the motor will be rotationally driven and will effect braking utilizing the gearing ratio and the inertia of the motor. Due to the gearing, this inertia can be considerable, because a pick-finding gearing has the task of substantially reducing the speed of the motor during the pick-finding operation, for example from 1400 to 35 rpm. Since the gearing, due to its cost and also with respect to the function, does not have a high efficiency, antifriction bearings are not used. The bearing friction is therefore an additional braking factor. Prior to the end of the deceleration period for the shed-forming machine, the friction coupling of the braking mechanism can be released, so that the accelerated pick-finding gearing stops again in a natural manner.

Members can also be built into the pick-finding gearing which substantially increase the flywheel moment $GD^2$. Such members can move in the preferred direction of rotation during the braking operation by the gearing through freewheel couplings.

Another additional braking help involves supplying current to the motor during the braking operation in order to build up a magnetic field which acts in a direction opposite the direction of rotation of the rotor.

To start the braking operation on the shed-forming machine, any desired conventional control transmission can be used. For example, the braking linkage of the weaving machine can be connected to the axle 48,58 or 68 on which the respective control lever 47,57 or 67 sits. An electrical braking impulse of the weaving machine can alternatively be guided to an electromagnet which forwards the braking force through the axle 48, 58 or 68. This magnet can also be provided on the braking disk 40,50 or 60 or on the fixed counterpart 44 or 54.

In the normal case, the braking mechanism is actuated only until the machines reach a standstill and is then released.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a weaving machine having a drive mechanism, a lifting unit, a shed-forming mechanism which has a rotatably supported shaft and has selectively actuable braking means for resisting rotation of said shaft, first means adapted to drivingly couple said drive mechanism of said weaving machine to said shaft of said shed-forming mechanism, and second means adapted to drivingly couple said shaft of said shed-forming mechanism to said lifting unit, the improvement comprising wherein said braking means includes: a first member which is axially movably supported on and fixed against rotation relative to said shaft, and which has a first annular braking surface thereon coaxial with said shaft; means defining a second annular braking surface which is coaxial with and fixed against axial movement with respect to said shaft; means for preventing rotation of said second annular braking surface about the axis of said shaft; and actuating means cooperable with said first member for effecting axial movement of said first member between two positions in which said first and second annular braking surfaces are respectively engaging and spaced from each other.

2. The weaving machine according to claim 1, wherein said first means selectively drivingly couples said drive mechanism of said weaving machine to said shaft of said shed-forming mechanism; including a second member which is rotatably supported on and fixed against axial movement with respect to said shaft, selectively actuable drive means for effecting rotation of said second member about the axis of said shaft, and means defining a respective annular friction surface on each of said first and second members coaxial with said shaft; and wherein said actuating means is adapted to move said first member axially between positions in which said annular friction surfaces are respectively engaging and spaced from each other, rotation of said second member by said drive means when said annular friction surfaces are engaged effecting rotation of said second member, said first member and said shaft.

3. The weaving machine according to claim 2, wherein said means for preventing rotation of said second annular braking surface inlcudes a third member which is fixedly secured to a housing of said shed-forming mechanism, is located on a side of said first member remote from said second member, and has said second annular braking surface thereon, said first member being movable to a position in which said annular braking surfaces are free of engagement and said annular friction surfaces are free of engagement.

4. The weaving machine according to claim 3, wherein each of said annular braking surfaces and each of said annular friction surfaces is frusto-concial.

5. The weaving machine according to claim 4, wherein said actuating means includes means defining a circumferential groove on said first member, a control member having a portion supported for movement approximately axially of said shaft, and a roller rotatably supported on said portion of said control member and slidably received in said groove in said first member.

6. The weaving machine according to claim 5, wherein said second member is a gear, and wherein said drive means includes a motor having a pinion which drivingly engages said gear.

7. The weaving machine according to claim 2, wherein said means defining said second annular braking surface includes said second annular braking surface being provided on said second member coincident with said annular friction surface thereon, wherein said annular braking surface and said annular friction surface on said first member are coincident, and wherein said means for preventing rotation of said second annular braking surface about the axis of said shaft includes said drive means being adapted to resist rotation of said second member except when said drive means is actuated.

8. The weaving machine according to claim 7, wherein said annular surfaces on said first and second members are each frusto-conical surfaces.

9. The weaving machine according to claim 8, wherein said actuating means includes means defining a circumferential groove on said first member, a control member having a portion supported for movement generally axially of said shaft, and a roller rotatably supported on said portion of said control member and slibably received in said circumferential groove in said first member.

10. The weaving machine according to claim 7, wherein said drive means inlcudes a motor and self-locking gearing means coupling said motor to said second member for preventing rotation of a drive shaft of said motor by said second member.

11. The weaving machine according to claim 7, wherein said second member is a gear, wherein said drive means includes a motor having a pinion which drivingly engages said gear, and wherein said means for preventing rotation of said second annular braking surface includes said motor having means for resisting rotation of said pinion when said motor is de-energized.

12. The weaving machine according to claim 7, wherein said drive means includes freewheeling means for permitting said motor to coast to a stop when said annular braking surfaces are engaged.

13. The weaving machine according to claim 2, wherein said first means includes: a drive member rotatably supported on said shaft, fixed against axial movement with respect to said shaft, and having at least one tooth thereon, said drive mechanism of said weaving machine being drivingly coupled to said drive member; a coupling member axially slidably supported on said shaft, fixed against rotation with respect to said shaft, and having at least one tooth thereon; and means for effecting axial movement of said coupling member relative to said shaft between positions in which said teeth on said drive member and coupling member are respectively engaging and spaced from each other.

14. The weaving machine according to claim 1, wherein said means for preventing rotation of said second annular braking surface includes a second member which is fixedly secured to a housing of said shed-forming mechanism and which has said second annular braking surface provided thereon.

15. The weaving machine according to claim 14, wherein each of said annular braking surfaces is frustoconical.

16. The weaving machine according to claim 14, wherein said actuating means includes means defining a circumferential groove in said first member, a control member having a portion supported for movement approximately axially of said shaft, and a roller which is rotatably supported on said portion of said control member and is slidably received in said circumferential groove in said first member.

* * * * *